US005581330A

United States Patent [19]

Pietrowski et al.

[11] Patent Number: 5,581,330

[45] Date of Patent: Dec. 3, 1996

[54] METHOD AND APPARATUS FOR REDUCING RESIDUAL TONER VOLTAGE

[75] Inventors: Kenneth W. Pietrowski, Penfield; Samuel W. Ing, Webster; Roger L. Bullock, Webster; Thomas Fleck, Webster; Charles H. Tabb, Penfield; Zhao-Zhi Yu, Webster; Jeffrey J. Folkins; Daniel M. Bray, both of Rochester; Cyril G. Edmunds, Webster, all of N.Y.

[73] Assignee: Xerox Corporation, Stamford, Conn.

[21] Appl. No.: 347,616

[22] Filed: Nov. 30, 1994

[51] Int. Cl.[6] ..... G03G 15/02

[52] U.S. Cl. ..... 355/221; 355/326 R

[58] Field of Search ..... 355/222, 225, 355/326 R, 327, 328, 221

[56] References Cited

U.S. PATENT DOCUMENTS

| | | | |
|---|---|---|---|
| 4,033,688 | 7/1977 | Orthmann | 355/327 X |
| 4,141,648 | 2/1979 | Gaitten et al. | 355/225 |
| 4,432,631 | 2/1984 | Bacon et al. | 355/225 |
| 4,647,181 | 3/1987 | Kohyama et al. | 355/222 X |
| 4,660,059 | 4/1987 | O'Brien | 346/157 |
| 4,761,669 | 8/1988 | Langdon | 355/326 R |
| 4,791,452 | 12/1988 | Kasai et al. | 355/326 R |
| 4,819,028 | 4/1989 | Abe | 355/326 R X |
| 4,833,503 | 5/1989 | Snelling | 355/259 |
| 5,097,296 | 3/1992 | Goto et al. | 355/328 |
| 5,181,072 | 1/1993 | Furuya et al. | 355/225 |
| 5,208,636 | 5/1993 | Rees et al. | 355/219 |
| 5,241,356 | 8/1993 | Bray et al. | 355/328 |
| 5,258,820 | 11/1993 | Tabb | 355/328 |
| 5,359,393 | 10/1994 | Folkins | 355/208 |
| 5,365,325 | 11/1994 | Kumasaka et al. | 355/326 |
| 5,438,401 | 8/1995 | Murayama et al. | 355/326 R |

FOREIGN PATENT DOCUMENTS 1-340663 9/1991 Japan .

OTHER PUBLICATIONS

Xerox Disclosure Journal; Brian E. Springett; *Maintaining Photoreceptor Charge Potential Constant;* vol. 4 No. 5 Sep./Oct. 1979.

European Patent Application; Charles H. Tabb; Publication No. 0 581 563 A3; *Prerecharge device for voltage uniformity in read color systems;* Publication Date Feb. 2, 1994.

*Primary Examiner*—Robert Beatty

[57] ABSTRACT

In a multi-color imaging apparatus utilizing a recharge step between two image creation steps for conditioning a charge retentive surface pursuant to forming the second of the two images, a voltage sensitive corona generating device having a high characteristic slope described in a graph of the current delivered to a charge receiving surface (I) vs. grid minus charge receiving surface voltage (V) is used to both reduce the residual toner voltage across the previously toned image, and to charge the toned and untoned areas of the charge retentive surface to a substantially uniform level so that developability conditions for the subsequent image are improved.

15 Claims, 7 Drawing Sheets

METHOD AND APPARATUS FOR REDUCING RESIDUAL TONER VOLTAGE

BACKGROUND OF THE INVENTION

This invention relates generally to color imaging and more particularly to the use of plural exposure and development steps for such purposes.

One method of printing in different colors is to uniformly charge a charge retentive surface and then optically expose the surface to information to be reproduced in one color. This information is rendered visible using marking particles followed by the recharging of the charge retentive surface prior to a second exposure and development. This recharge/expose/and develop process may be repeated to subsequently develop images of different colors in superimposed registration on the surface before the full color image is subsequently transferred to a support substrate. The different colors may be developed on the photoreceptor in an image on image development process, or a highlight color image development process (image next-to image). The images may be formed by using a single exposure device, e.g. ROS, where each subsequent color image is formed in a subsequent pass of the photoreceptor (multiple pass). Alternatively, each different color image may be formed by multiple exposure devices corresponding to each different color image, during a single revolution of the photoreceptor (single pass).

Several issues arise that are unique to the image on image process of creating multi-color images, in the attempt to provide optimum conditions for the development of subsequent color images onto previously developed color images. For example, during a recharge step, it is important to level the voltages among previously toned and untoned areas of the photoreceptor so that subsequent exposure steps (and the development thereof) are effected across a uniformly charged surface. The greater the difference in voltage between those image areas of the photoreceptor previously subjected to a development and recharge step; those image areas subjected to a development step, but not yet subjected to a recharge step; and those bare non-developed, untoned areas of the photoreceptor, the larger will be the difference in the development potential between these areas for the subsequent development of image layers thereon.

Another issue that must be addressed with image on image color formation using a recharge step is the residual charge and the resultant voltage drop that exists across the toner layer of a previously developed area of the photoreceptor. Although it may be possible to achieve voltage uniformity by recharging this previously toned layer to the same voltage level as neighboring bare areas, the associated residual toner voltage ($V_t$) prevents the effective voltage above any previously developed toned areas from being re-exposed and discharged to the same level as neighboring bare photoreceptor areas which have been exposed and discharged to the actual desired voltage levels. Furthermore, the residual charge associated with previously developed toner images reduces the dielectric and effective development field in the toned areas, affecting the consistency and desired uniformity of the developed mass of subsequent toner images. The problems become increasingly severe as additional color images are subsequently exposed and developed thereon. Color quality is severely threatened by the presence of the toner charge and the resultant voltage drop across the toner layer. The change in voltage due to the toned image can be responsible for color shifts, increased moire, increased color shift sensitivity to image misregistration and motion quality, toner spreading at image edges, and loss in latitude affecting many of the photoreceptor subsystems. Thus, it is ideal to reduce or eliminate the residual toner voltage of any previously developed toned images.

Based on the foregoing, a highly reliable and consistent manner of recharging the photoreceptor to a uniform level and minimizing the residual voltage on previously toned areas is needed so that developability is not threatened when applying subsequent toner images on previous toned image layers.

The following references may be found relevant to the present disclosure.

U.S. Pat. No. 4,791,452 relates to a two-color imaging apparatus wherein a first latent image is formed on a uniformly charged imaging surface and developed with toner particles. The charge retentive surface containing a first developed or toned image, and undeveloped or untoned background areas is then recharged by a scorotron charging device prior to optically exposing the surface to form a second latent electrostatic image thereon. An electrical potential sensor detects the surface potential level of the drum to ensure that a prescribed surface potential level is reached. The recharging step is intended to provide a uniformly charged imaging surface prior to effecting a second exposure.

U.S. Pat. No. 4,819,028 discloses an electrophotographic recording apparatus capable of forming a clear multicolor image including a first visible image of a first color and a second visible image of a second color on a photoconductive drum. The electrophotographic recording apparatus is provided with a conventional charger unit and a second corona charger unit for charging the surface of the photoconductive drum after the first visible image is formed thereon so as to increase the surface potential of the photoconductive drum to prevent the first visible image from being mixed with a second color and also from being scratched off from the surface of the photoconductive drum by a second magnetic brush developing unit.

U.S. Pat. No. 4,761,669 relates to creating two-color images. A first image is formed using the conventional xerographic process. Thus, a charge retentive surface is uniformly charged followed by light exposure to form a latent electrostatic image on the surface. The latent image is then developed. A corona generator device is utilized to erase the latent electrostatic image and increase the net charge of the first developed image to tack it to the surface electrostatically. This patent proposes the use of an erase lamp, if necessary, to help neutralize the first electrostatic image. A second electrostatic image is created using an ion projection device. The ion image is developed using a second developer of a different color.

U.S. Pat. No. 4,033,688 discloses a color copying apparatus which utilizes a light-lens scanning device for creating plural color images. This patent discloses multiple charge/expose/develop steps.

US. Pat. No. 4,833,503 discloses a multi-color printer wherein a a recharging step is employed following the development of a first image. This recharging step, according to the patent is used to enhance uniformity of the photoreceptor potential, i.e. neutralize the potential of the previous image.

U.S. Pat. No. 4,660,059 discloses an ionographic printer. A first ion imaging device forms a first image on the charge retentive surface which is developed using toner particles.

The charge pattern forming the developed image is neutralized prior to the formation of a second ion image by a corona generating unit and an erase lamp.

U.S. Pat. No. 5,208,636, discloses a printing system wherein charged area images and discharged area images are created, the former being formed first and the latter being proceeded by a recharging of the imaging surface.

U.S. Pat. No. 5,241,356 discloses a multi-color printer wherein charged area images and discharged area images are created, the former being formed first, followed by an erase step and a recharge step before the latter is formed. An erase lamp is used during the erase step to reduce voltage non-uniformity between toned and untoned areas on a charge retentive surface.

U.S. Pat. No. 5,258,820 discloses a multi-color printer wherein charged area images and discharged area images are created. An erase lamp is used following development of a charged area (CAD), and a pre-recharge corona device is used following development of a discharged area (DAD) and prior to a recharge step, to reduce voltage non-uniformity between toned and untoned images on a charge retentive surface.

Application No. Hei 1-340663, Application date Dec. 29, 1989, Publication date Sep. 4, 1991, assigned to Matsushita Denki Sangyo K.K., discloses a color image forming apparatus wherein a first and second charging device are used before exposure and development of an image, where the potential of the image forming unit is higher after passing the first charging device than after passing the second charging device, to eliminate the contrast potential reduction normally caused by applying color toners onto other color toners, and also to prevent toner spray during the exposure process.

The concurrently filed, copending application for patent entitled "Method and Apparatus for Reducing Transferred Background Toner", Ser. No. 08/346,708, filed on 30 Nov. 1994, by a common assignee as the present application, discloses a recharge step between two image creation steps for conditioning a charge retentive surface pursuant to forming the second of the two images, wherein a corona generating device is used to both charge the toned and untoned areas of the charge retentive surface, and to keep wrong-charge toner developed in the background areas at a charge level distinct from the toner developed in the image areas, so that the wrong-charge background toner does not transfer to a support substrate with the image.

The concurrently filed, copending application for patent entitled "Split Recharge Method and Apparatus for Color Image Formation", Ser. No. 08/347,617, filed on 30 Nov. 1994, by a common assignee as the present application, discloses a recharge step between two image creation steps for recharging a charge retentive surface to a predetermined potential pursuant to forming the second of the two images. A first corona generating device recharges the charge retentive surface to a higher absolute potential than a predetermined potential, and then a second corona generating device recharges the charge retentive surface to the predetermined potential. An electrical charge associated with the first image is substantially neutralized after being recharged by the first and second corona generating device.

A number of commercial printers employ the charge/expose/ develop/recharge imaging process. For example, the Konica 9028, a multi-pass color printer forms a single color image for each pass. Each such pass utilizes a recharge step following development of each color image. The Panasonic FPC1 machine, like the Konica machine is a multi-pass color device. In addition to a recharge step the FPC1 machine employs an AC corona discharge device prior to recharge.

SUMMARY OF THE INVENTION

In accordance with one aspect of the invention, a corona generating device recharges a charge retentive surface to a predetermined voltage. The charge retentive surface has at least one image developed thereon having a residual image voltage associated therewith. The corona generating device comprises an electrode, a voltage control surface, and a voltage source coupled to the electrode and the voltage control surface. The voltage source supplies an AC voltage to the electrode for reducing the image voltage associated with the developed image. The corona generating device delivers an output current through the voltage control surface and the charge retentive surface. A graph of the output current delivered to the charge retentive surface as a function of the difference in voltage across the voltage control surface and the voltage across the charge retentive surface has a high slope in the region of interest, for recharging the charge retentive surface to a substantially uniform predetermined voltage level, so that subsequent development thereon is optimized.

In accordance with another aspect of the invention, a printing machine for creating multiple images is disclosed, comprising a charge retentive surface having a developed image thereon, the developed image having a residual image voltage associated therewith. The printing machine also comprises a corona generating device, disposed adjacent to the charge retentive surface. The corona generating device comprises an electrode, a voltage control surface, and a voltage source coupled to the electrode and the voltage control surface. The voltage source supplies an AC voltage to the electrode for reducing the image voltage associated with the developed image. The corona generating device delivers an output current through the voltage control surface and the charge retentive surface. A graph of the output current delivered to the charge retentive surface as a function of the difference in voltage across the voltage control surface and the voltage across the charge retentive surface has a high slope in the region of interest, for recharging the charge retentive surface to a substantially uniform predetermined voltage level, so that subsequent development thereon is optimized.

In accordance with yet another aspect of the invention, a method for creating multiple images is disclosed. The method comprises the steps of recording a latent image on a charge retentive surface; developing the latent image; energizing a corona generating device having a voltage control surface in close proximity with the corona generating device and the charge retentive surface by supplying an AC voltage to the corona generating device, to produce an output current through the voltage control surface and the charge retentive surface, wherein a graph of the output current through the charge retentive surface as a function of the difference in voltage across the voltage control surface and the voltage across the charge retentive surface in the region of interest has a high slope; and recharging the charge retentive surface with the developed image thereon to a substantially uniform predetermined voltage level.

BRIEF DESCRIPTION OF THE DRAWINGS

FIG. 31 shows the photoreceptor voltage profile after a third development step;

DETAILED DESCRIPTION OF THE PREFERRED EMBODIMENT OF THE INVENTION

This invention relates to an imaging system which is used to produce an image on image color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass image on image color process system, and a single or multiple pass highlight color system.

Figure 1:
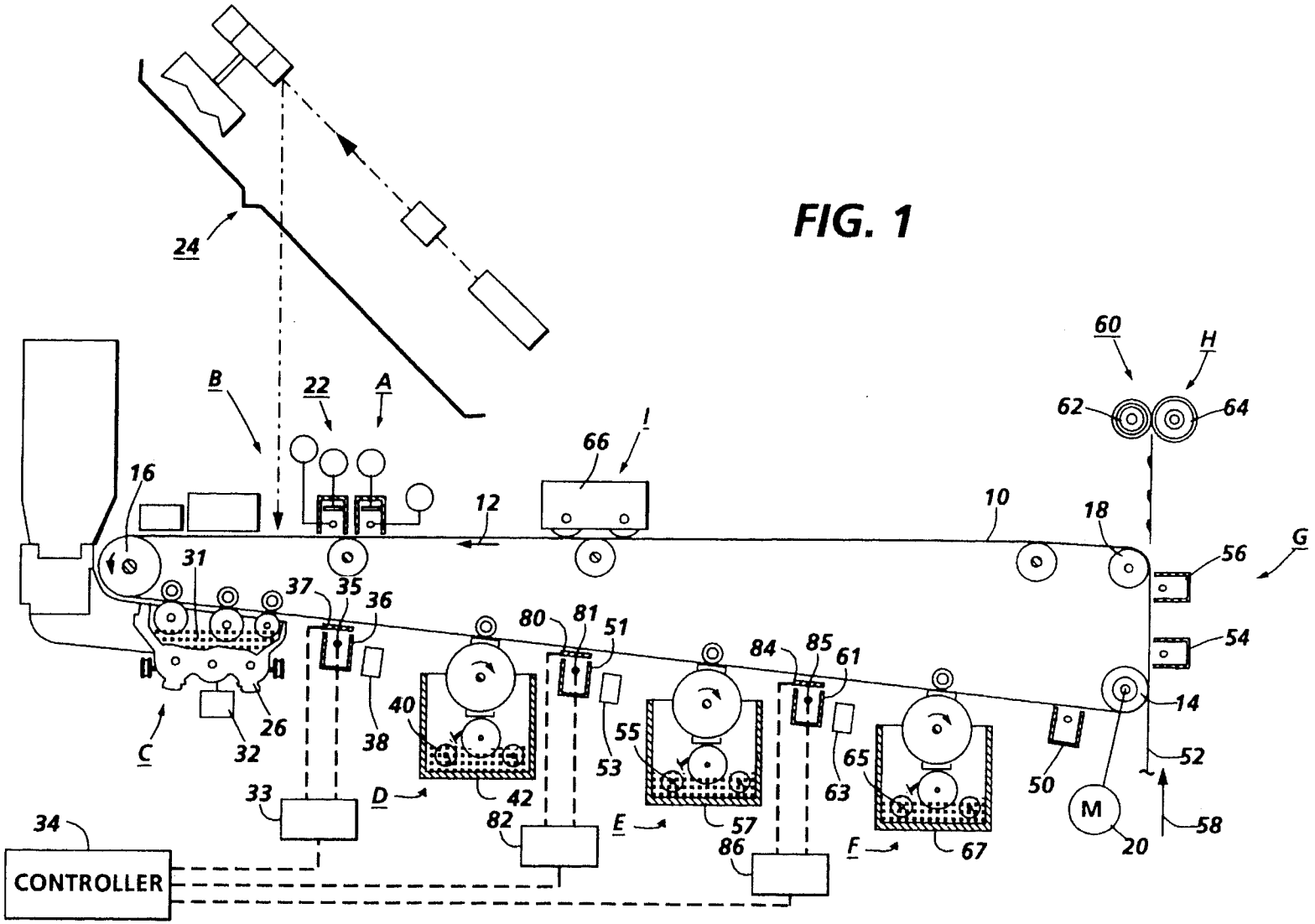
FIG. 1 is schematic illustration of an imaging apparatus incorporating the development system features of the invention.

Turning now to FIG. 1, the electrophotographic printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14 and two tension rollers 16 and 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relative high, substantially uniform, preferably negative potential.

Next, the charged portion of photoconductive surface is advanced through an imaging station B. At exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices.

The photoreceptor, which is initially charged to a voltage $V_O$, undergoes dark decay to a level $V_{ddp}$ equal to about −500 volts. When exposed at the exposure station B it is discharged to $V_{background}$ equal to about −50 volts. Thus after exposure, the photoreceptor contains a monopolar voltage profile of high and low voltages, the former corresponding to charged areas and the latter corresponding to discharged or background areas.

At a first development station C, a magnetic brush developer structure, indicated generally by the reference numeral 26 advances insulative magnetic brush (IMB) material 31 into contact with the electrostatic latent image. The development structure 26 comprises a plurality of magnetic brush roller members. These magnetic brush rollers present, for example, positively charged black toner material to the charged image areas for development thereof. Appropriate developer biasing is accomplished via power supply 32. Electrical biasing is such as to effect charged area development (CAD) of the higher (more negative) of the two voltage levels on the photoreceptor with the material 31.

A voltage sensitive corona recharge device 36 having a high output current vs. voltage (I/V) characteristic slope (defined below) is employed for raising the voltage level of both the toned and untoned areas on the photoreceptor to a substantially uniform level. The current delivered by a device that is voltage sensitive is highly a function of the voltage level at a particular point on the photoreceptor surface, whereas a non-voltage sensitive (constant current) device delivers the same amount of current to different areas of the photoreceptor surface, regardless of differing voltage levels. The high I/V slope recharging device 36 serves to substantially eliminate any voltage difference between toned areas and bare untoned areas, so that subsequent imaging and development of different color toner images is effected across a uniformly charged surface of both the previously developed toner layer(s) and the bare untoned areas of the photoreceptor. The high I/V slope corona recharge device of the present invention has a corona generating electrode 35 and a voltage control surface 37 comprising a grid, each coupled to separate outputs of a voltage source, indicated generally in FIG. 1 by the reference numeral 33. The operating conditions of the corona generating device are pre-selected to produce the desired high I/V slope, characteristic of the graph of the output current of corona recharge device 36 at a particular toned or untoned region of the photoreceptor surface 10, as a function of the difference between the voltage control surface 37 potential and the photoreceptor surface 10 potential at the region of interest. In a preferred embodiment, power supply 33 supplies an AC voltage to the electrode of the high I/V slope corona recharge device, which correlates with substantial voltage uniformity between previously toned and untoned areas of the photoreceptor, as well as a reduced residual toner voltage across a previously developed toner layer, thereby enabling a more uniform, stable development field across both previously toned areas and untoned areas of the photoreceptor for the development of subsequent toner images thereon. The high I/V slope corona recharge device 36 may be of the scorotron type, having a voltage supplied by power supply 33 to both the corona wire 35 and the grid 37. An explanation of the properties affecting the characteristic high I/V slope of the recharge device of the present invention are described in further detail with reference to FIGS. 2A–5B.

A post CAD erase device (not shown) disposed adjacent the backside of the belt 10, may be used in conjunction with the recharge step to reduce the charge level of the photoreceptor in the untoned or developed areas. Such a post CAD erase step may be performed using a corona device or an exposure device. A post CAD erase step is described in further detail in U.S. Pat. No. 5,241,356, the relevant portions of which are hereby incorporated by reference herein.

A second exposure or imaging device 38 which may comprise a laser based output structure is utilized for selectively discharging the photoreceptor on toned areas and/or bare areas, pursuant to the image to be developed with the second color developer. After this point, the photoreceptor contains toned and untoned areas at relatively high voltage levels and toned and untoned areas at relatively low voltage levels. These low voltage areas represent image areas which will be developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by a non-interactive developer. A power supply (not shown) serves to electrically bias the developer structure to a level effective to develop the DAD image areas with negatively charged yellow toner particles 40.

A voltage sensitive corona recharge device 51 having a high I/V characteristic slope serves to condition both the toned and untoned areas of the photoreceptor, by recharging both these areas of the photoreceptor to a predetermined uniform level and reducing the residual toner voltage across the previously developed toned layer(s). The photoreceptor is then at a substantially uniform potential between bare areas and toned areas, in preparation for the creation of the third color image. The high I/V slope corona recharge device 51 may be an AC scorotron, having a voltage supplied by power supply 82 to both the corona wire 81 and the grid 80. The recharge device 51 having a high I/V characteristic slope which is the subject of the present invention, is described in further detail with reference to FIGS. 2A–5B.

A pre-recharge corona device (not shown) may be used in conjunction with a high I/V slope recharge device, to condition the voltages representative of both CAD and DAD developed images and background areas of the photoreceptor. A suitable pre-recharge corona device is described in U.S. Pat. No. 5,258,820, the relevant portions of which are hereby incorporated by reference herein.

A third latent image is created using an imaging or exposure member 53. In this instance, a second DAD image is formed, discharging both bare areas of the photoreceptor and toned areas of the photoreceptor that will be developed with the third color image. This image is developed using a third color toner 55 contained in a non-interactive developer housing 57. An example of a suitable third color toner is magenta. Suitable electrical biasing of the housing 57 is provided by a power supply, not shown.

A voltage sensitive corona recharge device 61 having a high I/V characteristic slope serves to recharge the photoreceptor and minimize the voltage differential between the previous toned layer(s) and the photoreceptor, so that the photoreceptor is at a substantially uniform potential between bare areas and toned areas, in preparation for the creation of fourth color image. The high I/V slope corona recharge device 61 may be of the scorotron type, having a voltage supplied by power supply 86 to both the corona wire 85 and the grid 84. The high I/V slope recharge device 61, which is the subject of the present invention, is described in further detail with reference to FIGS. 2A–5B.

A fourth latent image is created using an imaging or exposure member 63. A third DAD image is formed on both bare areas and previously toned areas of the photoreceptor that are to be developed with the fourth color image. This image is developed using a fourth color toner 65 contained in developer housing 67. An example of a suitable fourth color toner is cyan. Suitable electrical biasing of the housing 67 is provided by a power supply, not shown.

The developer housing structures 42, 57, and 67 are preferably of the type known in the art which do not interact, or are only marginally interactive with previously developed images. For example, a non-interactive, scavengeless development housing having minimal interactive effects between previously deposited toner and subsequently presented toner is described in U.S. Pat. No. 4,833,503, the relevant portions of which are hereby incorporated by reference herein.

To the extent to which some toner charge is totally neutralized, or the polarity reversed, thereby causing the composite image developed on the photoreceptor to consist of both positive and negative toner, a negative pre-transfer corotron member 50 is provided to condition the toner for effective transfer to a substrate using positive corona discharge.

Subsequent to image development a sheet of support material 52 is moved into contact with the toner images at transfer station G. The sheet of support material is advanced to transfer station G by conventional sheet feeding apparatus, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station G.

Transfer station G includes a transfer corona current source 54 which sprays positive ions onto the backside of sheet 52. This attracts the negatively charged toner powder images from the belt 10 to sheet 52. A detack corona current source 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station 1 using a cleaning brush structure contained in a housing 66.

The various machine functions described hereinabove including the voltage supplied by power supplies 33, 82, 86 to corona generating devices 36, 51 and 61 respectively, are generally managed and regulated by a controller 34, preferably in the form of a programmable microprocessor. The microprocessor controller 34 provides electrical command signals for operating all of the machine subsystems and printing operations described herein, imaging onto the photoreceptor, paper delivery, xerographic processing functions associated with developing and transferring the developed image onto the paper, and various functions associated with copy sheet transport and subsequent finishing processes. However, for purposes of description of the present invention, controller 34 is shown in FIG. 1 coupled only to power supplies 33, 82 and 86.

The corona recharge devices 36, 51, and 61 have been described with reference to FIG. 1 for purposes of example as a scorotron type. However, it is understood that a corona generating device having a high I/V slope for recharging the charge retentive surface having a toner image thereon could also be in the form of, for the purpose of further examples, a dicorotron, or a pin scorotron, all having a grid or other type of voltage control surface known in the art associated therewith. The grid is maintained at a preestablished potential and serves to terminate further charging of the photoreceptor surface when the potential on all portions of the photoreceptor surface reach a predetermined level corresponding to the intercept voltage. The intercept voltage is the surface voltage at which the current delivered thereto is zero. The intercept voltage is approximately equal to the grid voltage and can be controlled by varying the grid voltage. The grid can be grounded or biased by means of an external voltage source as shown in FIG. 1, or it can be self biased from the corona current by connecting the grid to ground arrangement through current flow sensitive devices. In a preferred embodiment, an AC device is used for optimal reduction of the residual toner voltage across a previously developed toner layer.

The predetermined surface potential after recharge by voltage sensitive corona recharge devices 36, 51 and 61 can be defined for an ideal dielectric by the following formula:

$$V_p = V_{intercept}(1-e^{-s/cv}) + V_{initial}\, e^{-s/cv}$$

where $V_p$ represents the predetermined surface voltage after recharge; $V_{intercept}$ represents the value of the voltage of the charge retentive surface at which the current delivered from the corona recharge device to the surface is zero; $V_{initial}$ represents the residual potential associated with either a previously toned developed image or an untoned region of the photoreceptor before recharge; c represents the localized capacitance of the toned or untoned region; v represents the process velocity of the photoreceptor surface; and s represents the characteristic (I/V) slope of the graph of the output current delivered to the charge retentive surface as a function of the difference between the grid potential and surface potential at the particular region of interest. When the value of s/cv is greater than or equal to 3, the advantageous effects of the present invention can be achieved: substantial voltage uniformity between toned and untoned areas of the photoreceptor after recharge, and a reduced residual toner voltage present on previously toned areas, so that the conditions for subsequent development on both the toned and untoned areas of the photoreceptor are optimized.

Figure 2A:
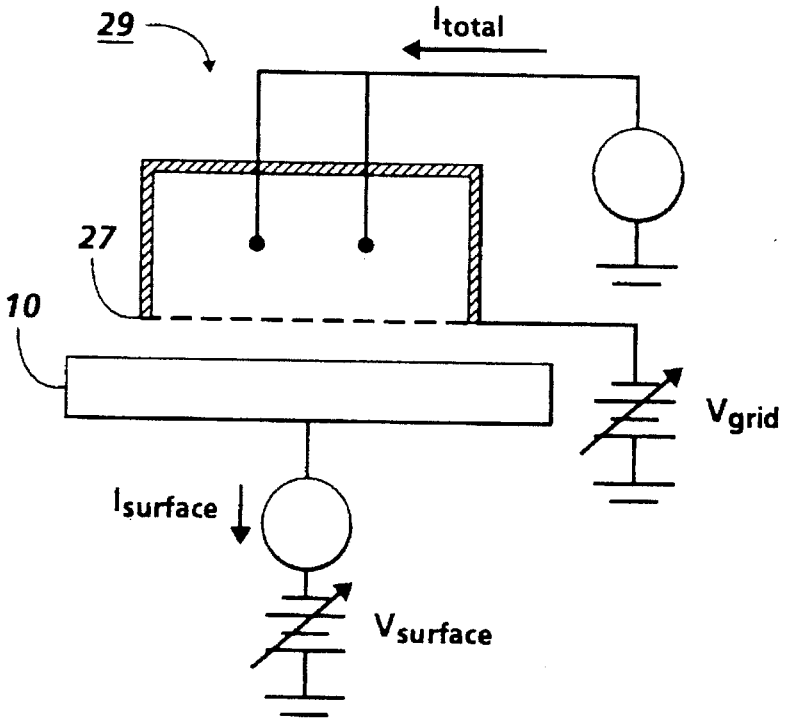
FIG. 2A shows an embodiment of the corona recharge device of the present invention.
Figure 2B:
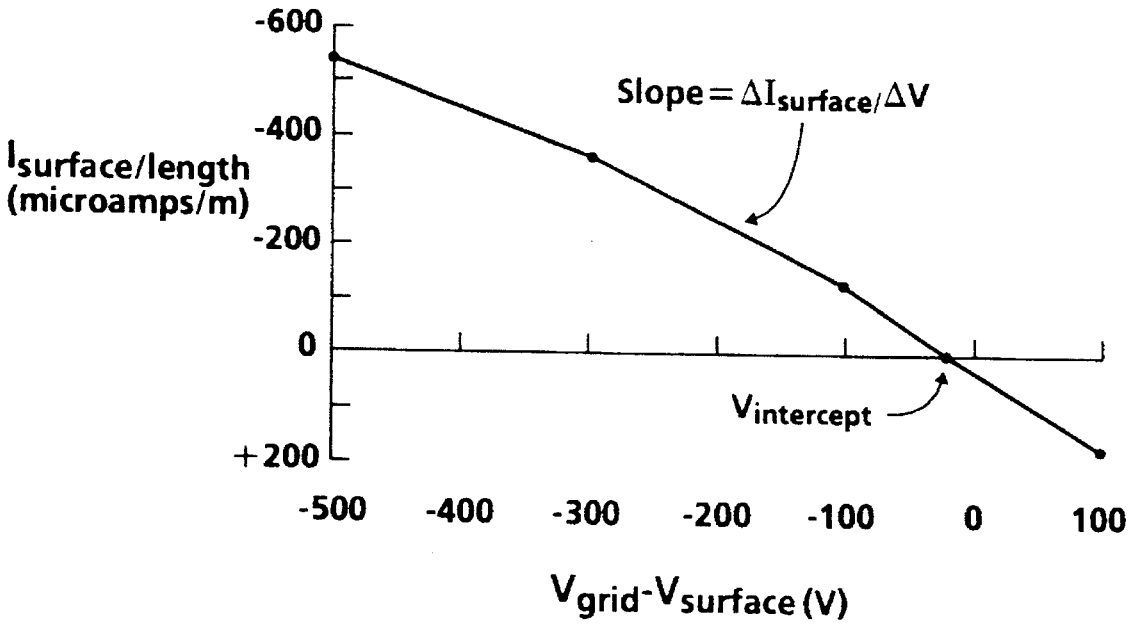
FIG. 2B shows a typical graph of the characteristic I/V slope, based on the embodiment of the present invention shown in FIG. 2A.

The I/V characteristic slope of the corona recharge devices 36, 51 and 61 of the present invention, an exemplary embodiment of which is shown in FIG. 2A, is further illustrated by the graph in FIG. 2B. In FIG. 2A, current flowing from a wire scorotron 29 to the photoreceptor surface 10 (I) at a particular region of the surface 10, as a function of the difference between the grid 27 potential and the photoreceptor surface 10 potential (V) at the particular region, is plotted in FIG. 2B to obtain the I/V slope (s). FIG. 2B also illustrates the $V_{intercept}$ point, at which there is no longer current flowing from the scorotron 29 to the photoreceptor surface 10.

It is clear by the above defined formula and the accompanying FIGS. 2A and 2B, that as the value of s/cv increases, the surface voltage ($V_p$) approaches the intercept voltage, as controlled by the grid voltage.

Figure 3A:
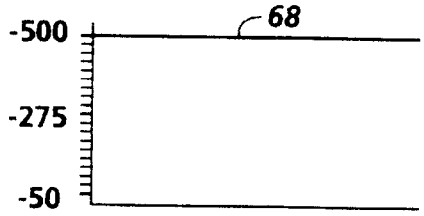
FIG. 3A shows the photoreceptor voltage profile after uniform charging.
Figure 3B:
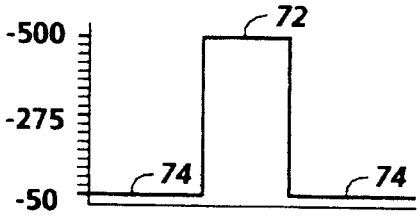
FIG. 3B shows the photoreceptor voltage profile after a first CAD exposure step.

The voltage profiles on the photoreceptor 10 depicting the image forming process steps are illustrated in FIGS. 3A through 3L. FIG. 3A illustrates the voltage profile 68 on the photoreceptor belt after the belt has been uniformly charged. The photoreceptor is initially charged to a voltage slightly higher than the −500 volts indicated but after dark decay the $V_{CAD}$ voltage level is −500 volts. After a first exposure at exposure station B, the voltage profile comprises high and low voltage levels 72 and 74, respectively. The level 72 at the original −500 volts represents the CAD image area to be developed by the black developer housing 26 while the level 74 at −50 volts (FIG. 3B) represents the area discharged by the laser 24 and corresponds to the background for the first development step.

Figure 3C:
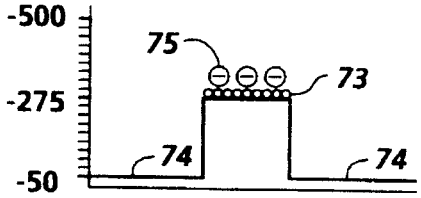
FIG. 3C shows the photoreceptor voltage profile after a first CAD development step.
Figure 3D:
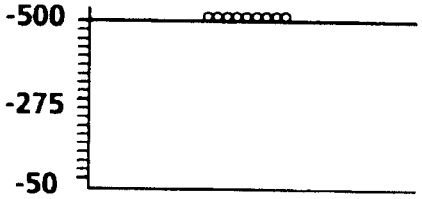
FIG. 3D shows the photoreceptor voltage profile after a recharging step.
Figure 3E:
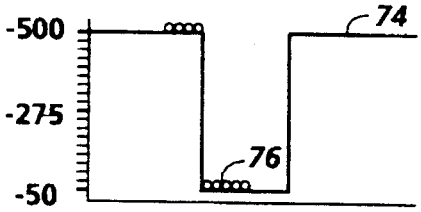
FIG. 3E shows the photoreceptor voltage profile after a second DAD exposure step.

During the first development step, black colored toner adheres to the CAD image area and causes the photoreceptor in the image area to be reduced to approximately −275 volts (FIG. 3C). Thus, a voltage difference of −225 volts exists between the toned 73 (−275 volts) and untoned 74 (−50 volts) areas of the photoreceptor and a negative charge is associated with the toner particles 73.

When the toned and untoned regions of the photoreceptor are subjected to the recharging step (FIG. 3D) using a high I/V slope corona recharge device 36, the efficiency of the voltage sensitive device enables both the toned and untoned regions to recharge to a uniform level. Substantial voltage uniformity is achieved between the toned and untoned regions, presenting a level surface for the exposure and development of subsequent color images.

Inside a negative toner layer, the high electric fields present typically prevent positive corona ions from getting into the layer. However, in a preferred embodiment, use of an AC corona recharge device, for example, a scorotron, having its operating conditions adjusted to produce a high I/V characteristic slope (described in further detail with reference to FIGS. 4A–5B), the voltage at the top of the toner layers reaches Vgrid at a faster rate and voltage uniformity is achieved between the toned areas and untoned areas of the photoreceptor. Once this point is reached, and during the remainder of the recharging period, the positive ions generated from the AC corona recharge device having a high I/V slope can more easily reach the top toner layer which thereby becomes substantially neutralized. As more positive charges emanating from the AC scorotron are able to attach themselves to the top surface of a toner layer, the average negative charge is closer to the bottom of a toner layer, closer to the photoreceptor. The residual voltage $V_t$ of the toner layer is thereby substantially eliminated, as $V_t$ is directly proportional to the integrated sum of the distances of the negative charge from the photoreceptor surface. The effective dielectric thickness of the toner layer is also reduced thereby. The development field is then at a more uniform level between previously toned and untoned regions of the photoreceptor after recharge and a subsequent exposure step, for subsequent development thereon.

Figure 3F:
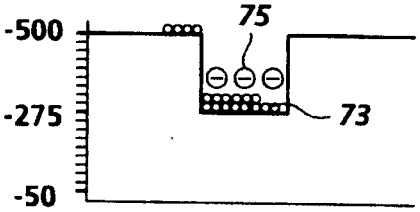
FIG. 3F shows the photoreceptor voltage profile after a second DAD development step.
Figure 3G:
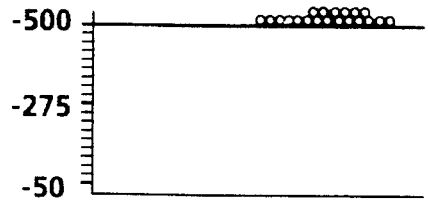
FIG. 3G shows the photoreceptor voltage profile after a second recharge step.

After the recharge step, the photoreceptor is again ready for image formation thereon. To this end, the second imaging device 38 discharges both previously developed areas and bare areas of the photoreceptor to form a DAD image area 76 shown in FIG. 3E, in superimposed registration on the previous image formed in FIG. 3D. The DAD image area is developed, as depicted in FIG. 3F, with yellow color toner 40, the toner particles 73 having a negative charge 75 associated therewith.

Figure 3H:
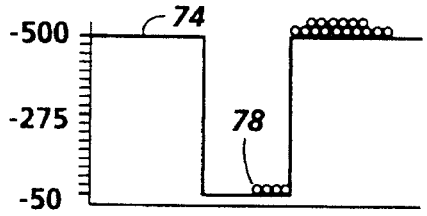
FIG. 3H shows the photoreceptor profile after a third DAD exposure step.
Figure 3I:
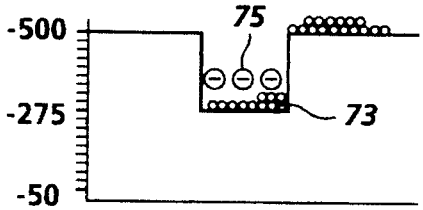
FIG. 3J shows the photoreceptor voltage profile after a third recharge step.
FIG. 3K shows the photoreceptor voltage profile after a fourth DAD exposure step.
FIG. 3L shows the photoreceptor voltage profile after a fourth DAD development step.
Figure 3J:
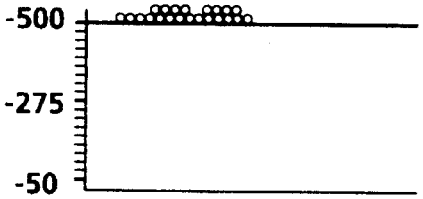

Prior to the creation of a third (second DAD) image 78, the photoreceptor is again recharged using a high I/V slope AC recharge device 51 (FIG. 3G), which device serves to create a substantially uniform voltage profile between previously toned images and bare areas of the photoreceptor, and also to reduce the residual toner voltage associated with the previously toned image areas, so that exposure and development conditions for a superimposed fourth color image are optimized. The DAD image 78 is formed using the exposure or imaging member 53, as illustrated in FIG. 3H. Development of a third magenta color toner 55 is shown in FIG. 31, the toner particles 73 having a negative charge 75 associated therewith.

Figure 3K:
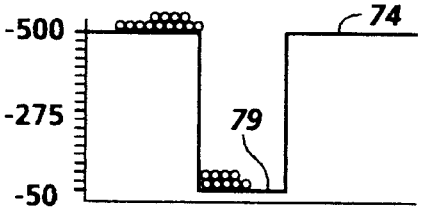
Figure 3L:
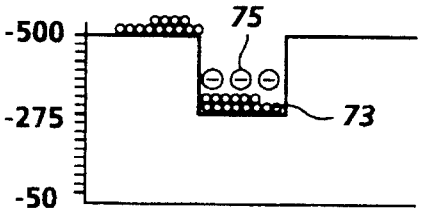

A high I/V slope AC corona device again recharges the toned and untoned areas of the photoreceptor belt (FIG. 3J) to a substantially uniform level of −500 volts, and also reduces the residual toner voltage associated with the previously toned image areas, so that exposure and development conditions for a fourth color image are optimized. The photoreceptor is again ready for DAD image formation by a fourth imaging device 63, as shown in FIG. 3K, in superimposed registration on the previously formed images. This DAD image 79 is developed with a fourth cyan color toner 65, using the developer housing 67 (FIG. 3L).

FIGS. 4A–4B, and 5A–5B are based on test results which demonstrate that a number of operating conditions of a corona recharge device can be altered to increase the characteristic I/V slope of the device. As exhibited on these graphs, a higher slope of I/V corresponds with a reduced residual toner voltage ($V_t$), based on use of an AC scorotron device. Use of an AC scorotron for the recharge device in the present invention has demonstrated the greatest dependence on I/V slope and therefore, the greatest reduction in $V_t$.

Figure 4A:
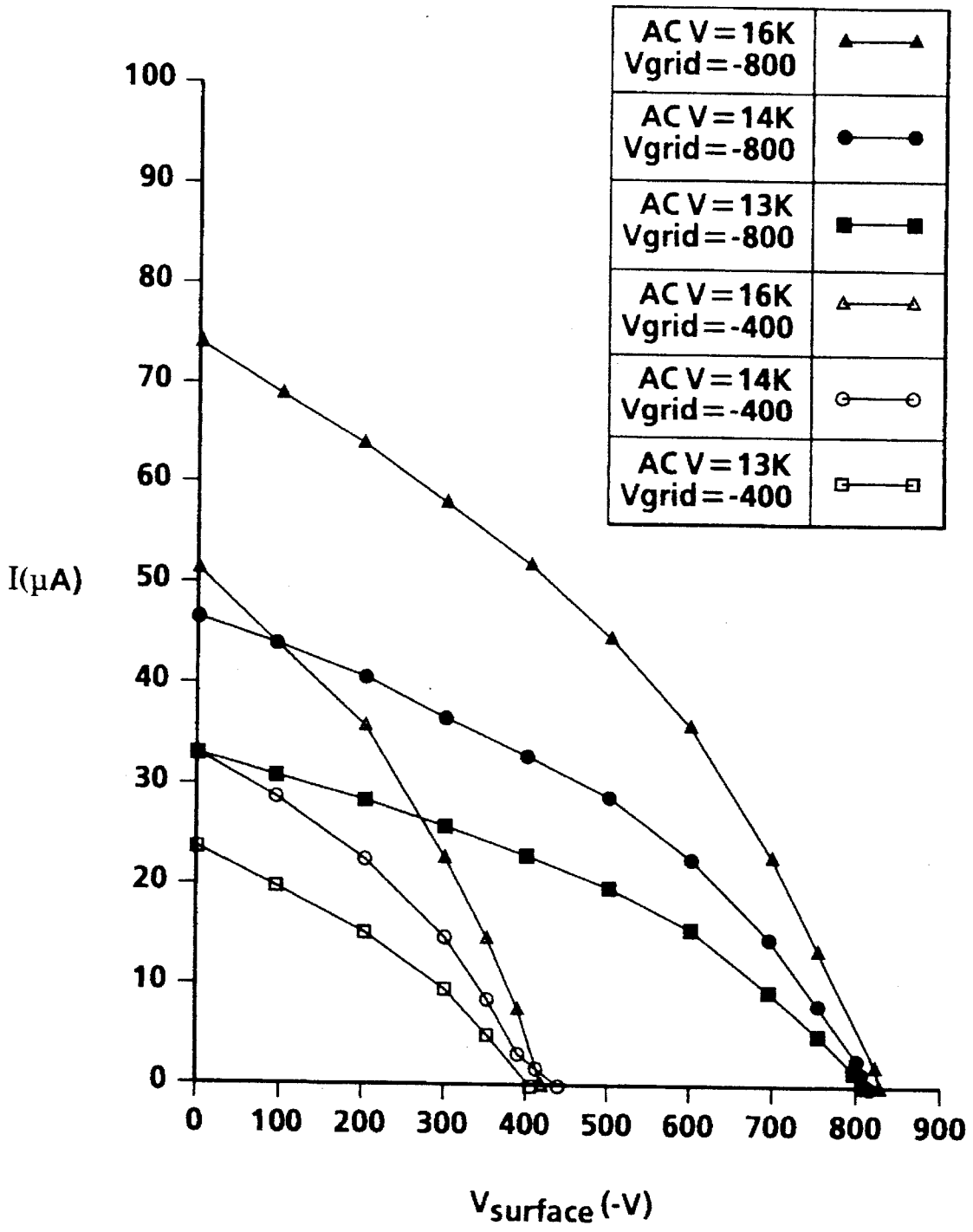
FIG. 4A shows a typical graph of output current vs. grid voltage (I/V) of an AC scorotron device used for the recharge steps of 3D, 3G, and 3J.
Figure 4B:
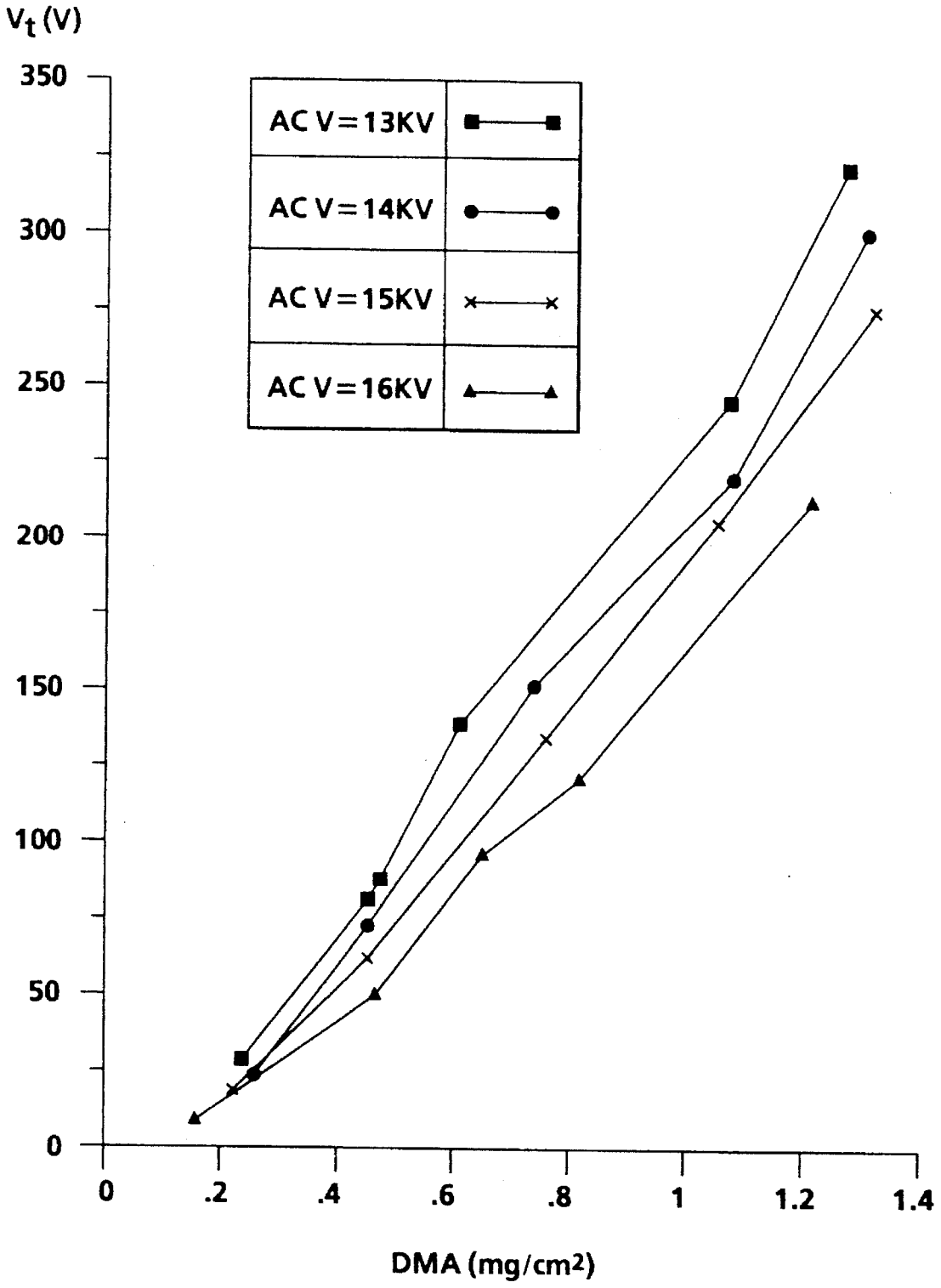
FIG. 4B shows a graph of residual toner voltage vs. developed mass per unit area (DMA) using an AC scorotron device for the recharge steps of 3D, 3G, and 3J.

FIG. 4A is a graph showing the characteristic I/V slope of an AC scorotron device at peak to peak operating voltages (AC V) varying between 13KV p-p and 16KV p-p at two constant grid potentials (Vgrid). At higher peak to peak operating voltages, the AC corona generating device generates a higher I/V slope curve, which in turn corresponds to a lower $V_t$. FIG. 4B is a graph showing the residual toner voltages ($V_t$) of increasing DMA levels, at varying operating voltages.

FIG. 4A illustrates that at higher peak to peak operating voltages, the slope of I/V is increased at both Vgrid levels of −400 volts and −800 volts. The highest slope of the graph of FIG. 4A corresponds with a 16KV peak to peak operating voltage, which corresponds with the lowest residual toner voltage levels ($V_t$) as shown in FIG. 4B. Correspondingly, the lowest I/V slope curve of FIG. 4A is shown at a 13KV peak to peak operating voltage, which corresponds with the highest residual toner voltage levels ($V_t$) as shown in FIG. 4B.

Figure 5A:
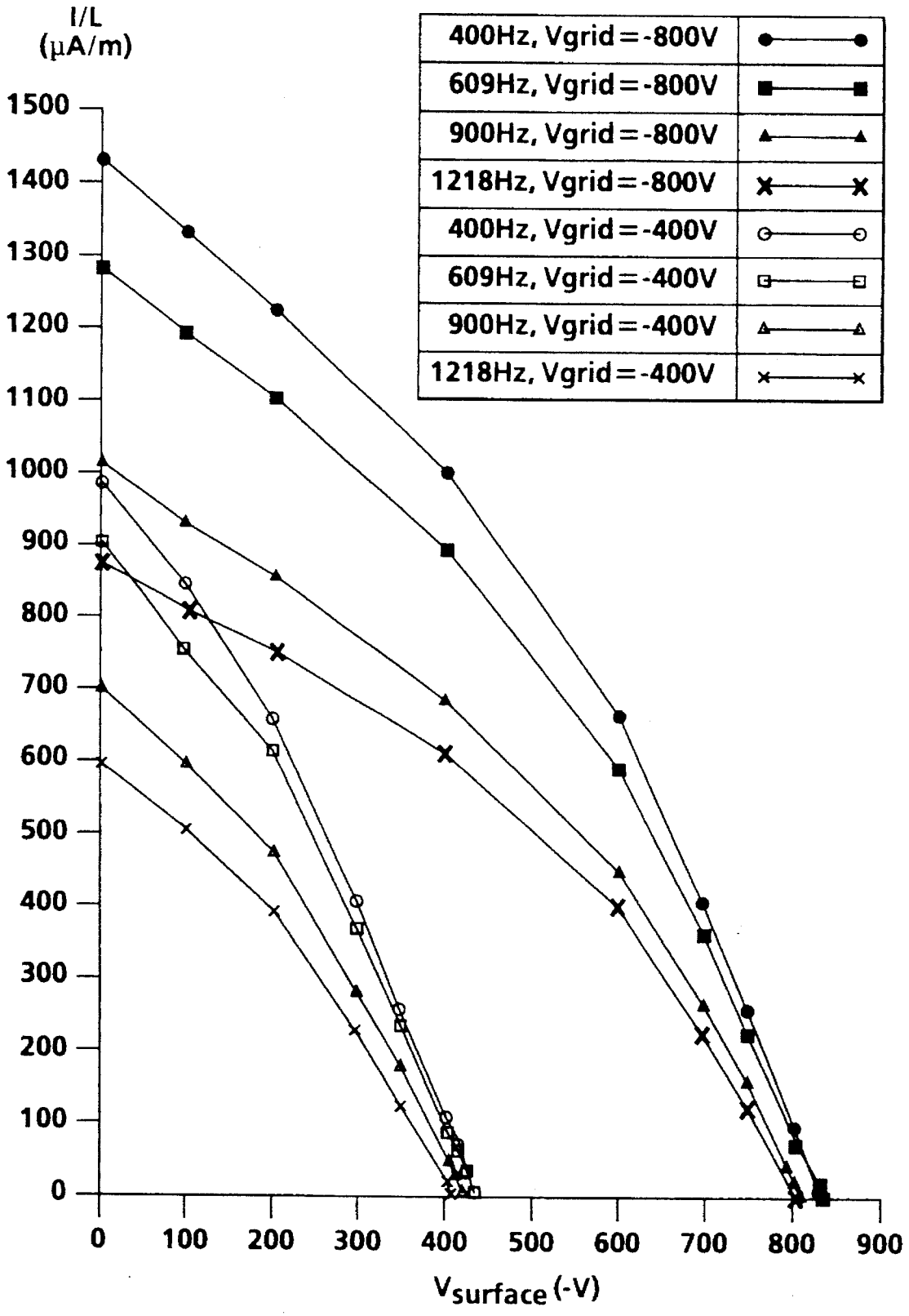
FIG. 5A shows a graph of output current per unit length vs. grid voltage (I/V) using an AC scorotron device for the recharge steps of 3D, 3G, and 3J.
Figure 5B:
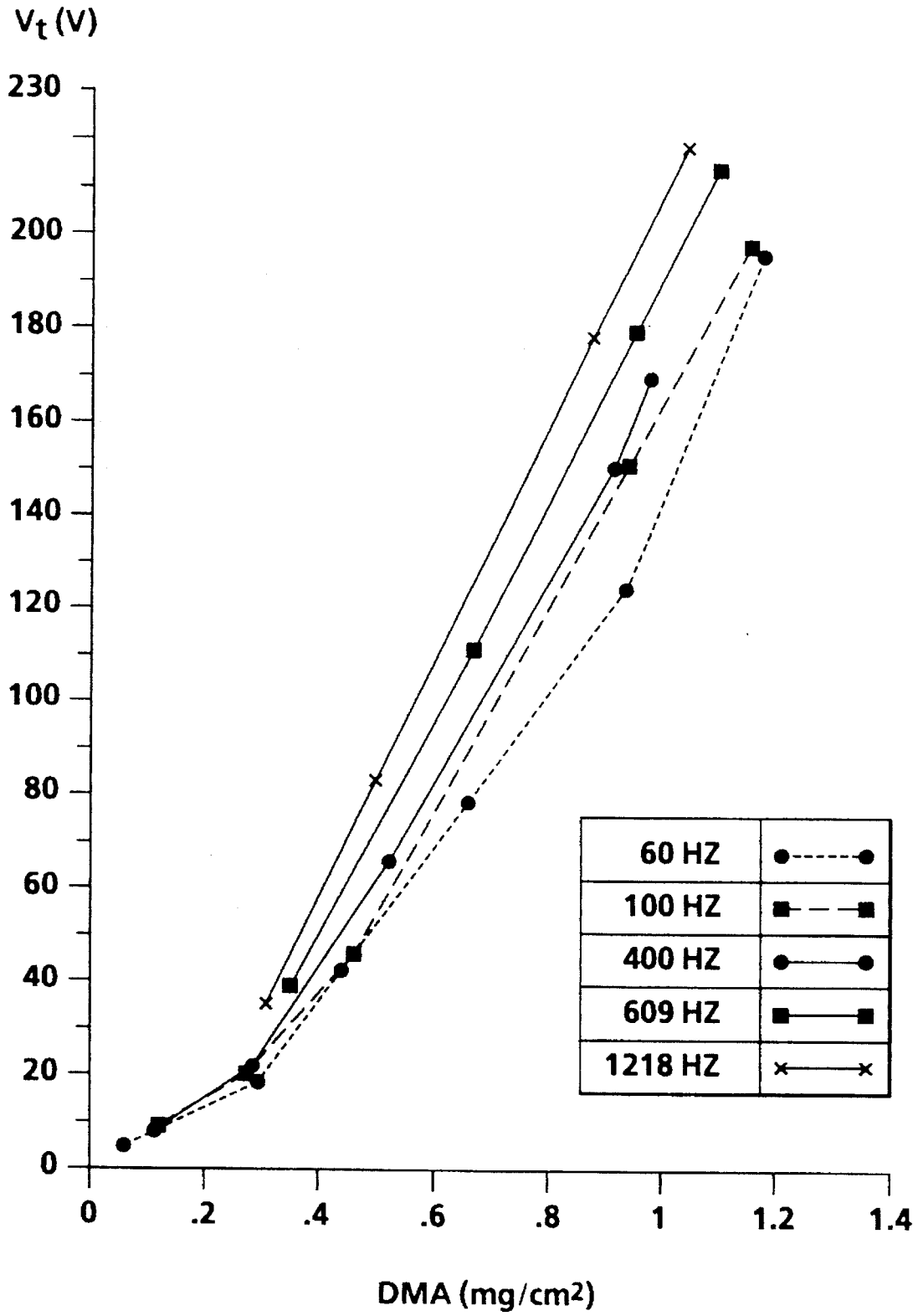
FIG. 5B shows a graph of residual toner voltage vs. DMA using an AC scorotron device for the recharge steps of 3D, 3G, and 3J.

Also, at lower operating frequencies, the AC scorotron generates a higher I/V slope curve, which in turn corresponds to a lower $V_t$. FIGS. 5A–5B are graphs showing the characteristic I/V slope of an AC wire scorotron device at varying operating frequencies, and their respective correlation to residual voltage levels of toner ($V_t$) at increasing DMA levels, based on two different constant grid potential settings. FIG. 5A shows that at lower operating frequencies, the slope of I/V is increased at both Vgrid levels of −400 volts and −800 volts. The highest slope is shown at an operating frequency of 400Hz, which corresponds with the lowest toner voltage levels ($V_t$) as shown in FIG. 5B. The lowest I/V slope curve of FIG. 5A corresponds with an operating frequency of 1218Hz, which corresponds with the highest toner voltage levels on FIG. 5B. It will be understood, however, that if an electrode, such as a wire, of a corona generating device used in the present invention, has a dielectric coating thereon, for example, in a dicorotron, the relationship of I/V slope to the operating frequency will be inverse to that of a bare electrode, for example, a pin of a pin scorotron, or a bare wire of a scorotron as illustrated in FIGS. 5A and 5B. Thus, in case of a dicorotron, a high I/V slope will correspond with an increased operating frequency of the voltage supplied to the device.

There is also a dependence to a higher I/V slope curve by decreasing the spacing of the recharge device to the photoreceptor.

While the foregoing description was directed to a CAD-DAD$^n$ image on image process color printer where a full color image is built in a single pass of the charge retentive surface, it will be appreciated that the invention may also be used in a DAD$^n$, CAD$^n$ or CAD-DAD$^n$ in both single pass or multiple pass systems, as well as in a single or multiple highlight color process machine.

What is claimed is:

1. A corona generating device for recharging a charge retentive surface to a predetermined voltage, wherein said charge retentive surface has an image developed thereon having an image voltage associated therewith, comprising:

an electrode;

a voltage control surface;

a voltage source, coupled to said electrode to generate an output current through said voltage control surface and the charge retentive surface, wherein a graph of the output current to the charge retentive surface as a function of the difference in voltage across said voltage control surface and the voltage across the charge retentive surface has a high slope, for recharging the charge retentive surface to a substantially uniform predetermined voltage, so that subsequent development thereon is optimized; and a controller for controlling the predetermined voltage according to the formula:

$$V_p = V_{intercept}(1-e^{-s/cv}) + V_{initial}\, e^{-s/cv}$$

where:

$V_p$ represents the predetermined voltage;

$V_{intercept}$ represents the value of the voltage of the charge retentive surface at which the current delivered by the corona generating device to the charge retentive surface is zero;

$V_{initial}$ represents the surface voltage associated with a previously developed image area or a non-image area of the charge retentive surface, before recharge;

c represents the localized capacitance associated with the previously developed image area or the non-image area of the charge retentive surface;

v represents the process velocity of the charge retentive surface; and s represents the slope of the output current to the charge retentive surface as a function of the difference in voltage across said voltage control surface and the voltage across the charge retentive surface.

2. A corona generating device according to claim 1, wherein s/cv has a value equal to or greater than 3.

3. A corona generating device for recharging a charge retentive surface to a predetermined voltage, wherein said charge retentive surface has an image developed thereon having an image voltage associated therewith, comprising:

an electrode;

a voltage control surface; and a voltage source, coupled to said electrode to generate an output current through said voltage control surface and the charge retentive surface, wherein a graph of the output current to the charge retentive surface as a function of the difference in voltage across said voltage control surface and the voltage across the charge retentive surface has a high slope, for recharging the charge retentive surface to a substantially uniform predetermined voltage, so that subsequent development thereon is optimized wherein said voltage source decreases the frequency of the voltage supplied to said electrode to generate the high slope of the output current as a function of the image voltage.

4. A corona generating device for recharging a charge retentive surface to a predetermined voltage, wherein said charge retentive surface has an image developed thereon having an image voltage associated therewith, comprising:

an electrode having a wire with a dielectric coating;

a voltage control surface; and a voltage source, coupled to said electrode to generate an output current through said voltage control surface and the charge retentive surface, wherein a graph of the output current to the charge retentive surface as a function of the difference in voltage across said voltage control surface and the voltage across the charge retentive surface has a high slope, for recharging the charge retentive surface to a substantially uniform predetermined voltage, so that subsequent development thereon is optimized;

wherein said voltage source increases the frequency of the voltage supplied to the wire having a dielectric coating thereon, to generate the high slope of the output current as a function of the image voltage.

5. A corona generating device for recharging a charge retentive surface to a predetermined voltage, wherein said charge retentive surface has an image developed thereon having an image voltage associated therewith, comprising: an electrode;

a voltage control surface;

a voltage source, coupled to said electrode to generate an output current through said voltage control surface and said charge retentive surface, wherein said voltage source supplies an AC voltage to said electrode, for reducing the image voltage associated with the developed image, and wherein a graph of the output current through said charge retentive surface as a function of the difference in voltage across said voltage control surface has a high slope, for recharging the charge retentive surface to a substantially uniform predetermined voltage level, so that subsequent development thereon is optimized; and a controller for controlling the predetermined voltage according to the formula:

$$V_p=V_{intercept}(1-e^{-s/cv})+V_{initial}e^{-s/cv}$$

where:

$V_p$ represents the predetermined voltage;

$V_{intercept}$ represents the value of the voltage of the charge retentive surface at which the current delivered by the corona generating device to the charge retentive surface is zero;

$V_{initial}$ represents the surface voltage associated with a previously developed image area or a non-image area of the charge retentive surface, before recharge;

c represents the localized capacitance associated with the previously developed image area or the non-image area of the charge retentive surface;

v represents the process velocity of the charge retentive surface; and s represents the slope of the output current to the charge retentive surface as a function of the difference in voltage across said voltage control surface and the voltage across the charge retentive surface.

6. A corona generating device according to claim 5, wherein s/cv has a value equal to or greater than 3.

7. A corona generating device for recharging a charge retentive surface to a predetermined voltage, wherein said charge retentive surface has an image developed thereon having an image voltage associated therewith, comprising:

an electrode;

a voltage control surface having a wire with a dielectric coating; and a voltage source, coupled to said electrode to generate an output current through said voltage control surface and said charge retentive surface, wherein said voltage source supplies an AC voltage to said electrode, for reducing the image voltage associated with the developed image, and wherein a graph of the output current through said charge retentive surface as a function of the difference in voltage across said voltage control surface has a high slope, for recharging the charge retentive surface to a substantially uniform predetermined voltage level, so that subsequent development thereon is optimized;

wherein said voltage source increases the frequency of the voltage supplied to the wire having a dielectric coating thereon, to generate the high slope of the output current as a function of the input voltage.

8. A printing machine for creating images comprising:

a charge retentive surface having a developed image thereon, the developed image having an image voltage associated therewith; and a corona generating device, disposed adjacent said charge retentive surface, said corona generating device comprising:

an electrode;

a voltage control surface;

a voltage source, coupled to said electrode to generate an output current through said voltage control surface and the charge retentive surface, wherein a graph of the output current to the charge retentive surface as a function of the difference in voltage across said voltage control surface and the voltage across the charge retentive surface has a high slope, for recharging the charge retentive surface to a substantially uniform predetermined voltage level so that subsequent development thereon is optimized; and a controller for controlling the predetermined voltage according to the formula:

$$V_p=V_{intercept}(1-e^{-s/cv})+V_{initial}e^{-s/cv}$$

where:

$V_p$ represents the predetermined voltage;

$V_{intercept}$ represents the value of the voltage of the charge retentive surface at which the current delivered by the corona generating device to the charge retentive surface is zero;

$V_{initial}$ represents the surface voltage associated with a previously developed image area or a non-image area of the charge retentive surface, before recharge;

c represents the localized capacitance associated with the previously developed image area or the non-image area of the charge retentive surface;

v represents the process velocity of the charge retentive surface; and s represents the slope of the output current to the charge retentive surface as a function of the difference in the voltage across said voltage control surface and the voltage across the charge retentive surface.

9. The printing machine according to claim 8, wherein s/cv has a value equal to or greater than 3.

10. A printing machine for creating images comprising:

a charge retentive surface having a developed image thereon, the developed image having an image voltage associated therewith; and a corona generating device, disposed adjacent said charge retentive surface, said corona generating device comprising:

an electrode;

a voltage control surface; and a voltage source, coupled to said electrode to generate an output current through said voltage control surface and the charge retentive surface, wherein a graph of the output current to the charge retentive surface as a function of the difference in voltage across said voltage control surface and the voltage across the charge retentive surface has a high slope, for recharging the charge retentive surface to a substantially uniform predetermined voltage level so that subsequent development thereon is optimized;

wherein said high output current as a function of the input voltage is generated by decreasing the operating frequency of the voltage supplied to said electrode by said voltage source.

11. The printing machine according to claim 10, wherein the charge retentive surface is capable of developing a plurality of images in superimposed registration in a single revolution of said charge retentive surface.

12. The printing machine according to claim 11 wherein each of the plurality of latent images is developed in a different color.

13. A printing machine for creating images comprising:.

a charge retentive surface having a developed image thereon, the developed image having an image voltage associated therewith; and a corona generating device, disposed adjacent said charge retentive surface, said corona generating device comprising:

an electrode having a wire with a dielectric coating;

a voltage control surface; and a voltage source, coupled to said electrode to generate an output current through said voltage control surface and the charge retentive surface, wherein a graph of the output current to the charge retentive surface as a function of the difference in voltage across said voltage control surface and the voltage across the charge retentive surface has a high slope, for recharging the charge retentive surface to a substantially uniform predetermined voltage level so that subsequent development thereon is optimized;

wherein said high output current as a function of the input voltage is generated by increasing the operating frequency of the voltage supplied to the wire having a dielectric coating thereon by said voltage source.

14. The printing machine according to claim 13, wherein the charge retentive surface is capable of developing a plurality of images in superimposed registration in a single revolution of said charge retentive surface.

15. The printing machine according to claim 14 wherein each of the plurality of latent images is developed in a different color.

* * * * *